US009855776B2

(12) United States Patent
Murakami

(10) Patent No.: US 9,855,776 B2
(45) Date of Patent: Jan. 2, 2018

(54) PRINTER

(71) Applicant: SATO HOLDINGS KABUSHIKI KAISHA, Tokyo (JP)

(72) Inventor: Kenji Murakami, Iwate (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/308,663

(22) PCT Filed: May 18, 2015

(86) PCT No.: PCT/JP2015/064191
§ 371 (c)(1),
(2) Date: Nov. 3, 2016

(87) PCT Pub. No.: WO2015/182421
PCT Pub. Date: Dec. 3, 2015

(65) Prior Publication Data

US 2017/0182814 A1 Jun. 29, 2017

(30) Foreign Application Priority Data

May 26, 2014 (JP) ..... 2014-107674

(51) Int. Cl.
*B41J 2/325* (2006.01)
*B41J 29/13* (2006.01)
*B41J 25/34* (2006.01)

(52) U.S. Cl.
CPC ..... *B41J 25/34* (2013.01); *B41J 2/325* (2013.01); *B41J 29/13* (2013.01); *B41J 2202/31* (2013.01)

(58) Field of Classification Search
CPC ..... B41J 25/34; B41J 2/325; B41J 29/13
See application file for complete search history.

(56) References Cited

FOREIGN PATENT DOCUMENTS

| | | | |
|---|---|---|---|
| JP | 5-46463 | U | 6/1993 |
| JP | 2533530 | Y2 | 4/1997 |
| JP | 11-199097 | A | 7/1999 |
| JP | 2005-53159 | A | 3/2005 |

OTHER PUBLICATIONS

Chinese Office Action, dated Jun. 28, 2017, 6 pages.

*Primary Examiner* — Bradley Thies
(74) *Attorney, Agent, or Firm* — Foley & Lardner LLP

(57) ABSTRACT

A printer has a print head, a cable harness connected to the print head, a head bracket detachably installed with the print head, a platen roller provided to face the print head, and a storage casing provided in one side of a feeding path and provided with a storage space in which the cable harness can be stored.

9 Claims, 6 Drawing Sheets

PRINTER

TECHNICAL FIELD

The present invention relates to a printer having a print head that performs printing on a paper sheet while feeding the paper sheet. In particular, the present invention relates to a printer having a print head detachably installed to allow maintenance or replacement.

BACKGROUND ART

FIG. 5 illustrates a printer Pa discussed in JP 11-199097 A. The printer Pa uses a continuous label sheet LA obtained by temporarily attaching glued labels onto a band-shaped liner sheet at equal intervals as a paper sheet. In the printer Pa, a label roll 100 obtained by rolling up the continuous label sheet LA is installed in a feeding reel 101, and the continuous label sheet LA is extracted and fed from the feeding reel 101 using a feeding roller 102, so that the print unit 103 performs printing on the label.

The print unit 103 has a thermal type print head 104 and a platen roller 105 to perform printing on the label through heat transfer using an ink ribbon 107 fed from the ribbon feeding mechanism 106. The printer Pa has a guide roller 108 and a sensor 109 capable of optically detecting a position of the label L in the course of feeding the continuous label sheet LA in order to allow the print unit 103 to perform printing on a predetermined position of the label L.

In the print unit 103, the print head 104 is provided on one side of a feeding path used to feed the continuous label sheet LA as a paper sheet. As illustrated in FIG. 6, a tip of the cable harness 110 stretching to one side of the feeding path is detachably connected to the print head 104 by interposing a connector 111. The print head 104 is detachably installed in the head bracket 112. The head bracket 112 is pivotally installed in a machine housing. The head bracket 112 can be pivoted between a printing position in which the print head 104 faces the platen roller 105 provided on the other side of the feeding path and a separated position in which the print head 104 is separated from the platen roller 105.

In order to perform maintenance or replacement of the print head 104, the head bracket 112 is pivoted to place the print head 104 in the separated position. In addition, in the separated position, the maintenance or replacement work is performed by detaching the print head 104 from the head bracket 112 and extracting the cable harness 110 at some extent while the cable harness 110 is connected or by removing the connector 111 and disconnecting the print head 104 from the cable harness 110 (refer to JP 2005-53159 A).

SUMMARY OF INVENTION

However, in the aforementioned printer Pa of the prior art, when maintenance or replacement is performed for the print head 104, the print head 104 is detached from the head bracket 112, and the cable harness 110 is extracted at some extent as illustrated in FIG. 6. However, if the length of the cable harness 110 is short, the print head is held near the head bracket 112 or its peripherals. Therefore, a work space is significantly small, and workability is degraded.

In order to address such problems, it is conceived that the work space can be widened by increasing the length of the cable harness 110 so that the print head 104 can be held far from the head bracket 112 or its peripherals. However, if the length of the cable harness 110 increases, an extra length of the cable harness 110 may be concentrated in one side of the feeding path and generate a failure by making contact with or being caught in peripherals while the print head 104 is installed in the head bracket 112.

In view of the aforementioned problems, it is therefore an object of the present invention to provide a printer capable of improving workability in the event of maintenance or replacement of the print head.

According to an aspect of the present invention, there is provided a printer including: a print head provided on one side of a feeding path used to feed a paper sheet to perform printing on the paper sheet fed along the feeding path; a cable harness stretching to the one side of the feeding path and having a tip connected to the print head; a head bracket in which the print head is detachably installed; a platen roller provided on the other side of the feeding path to face the print head; and a storage casing provided on the one side of the feeding path and provided with a storage space capable of storing the cable harness.

In this printer according to the present invention, it is possible to store the cable harness stretching to one side of the feeding path in the storage casing while the print head is installed in the head bracket.

In order to perform maintenance or replacement for the print head, the print head is detached from the head bracket, and the print head is carried to the outside after or while the cable harness is extracted from the storage casing. Maintenance or replacement of the print head is performed in this state. In the case of maintenance, maintenance may be performed while the print head is connected to the cable harness. Since the print head can be held far from the head bracket or its peripherals as long as a margin length of the cable harness, it is possible to widen the work space and improve workability.

In order to install the print head in the head bracket, the cable harness is stored in the storage casing during installation of the print head. Alternatively, after the installation, the cable harness is collectively stored in the storage casing. While the cable harness is stored in the storage casing, the cable harness is not exposed. Therefore, it is possible to prevent the margin length of the cable harness from being concentrated on one side of the feeding path and making contact with or being caught in peripherals to generate a failure.

In the printer described above, the storage casing may have a first opening used to insert a base end side of the cable harness and draw the cable harness to the storage space and a second opening configured to allow the cable harness stretching to the one side of the feeding path to access the storage space.

As a result, the cable harness is extracted or stored through the second opening. Since the cable harness is inserted into the first opening, passes through the second opening of the storage casing, and reaches the print head, the cable harness stretching to one side of the feeding path can be easily extracted from the storage space while it is collectively stored. Even when the cable harness is stored, the cable harness can be easily put into the storage space. While the cable harness is stored in the storage casing, it is possible to trimly arrange the cable harness without tangling.

In the printer described above, the storage casing may have a casing body having a container shape and being provided with a casing opening and an openable/closable lid for the casing opening, and the first and second openings may be formed on the casing body.

As a result, when the cable harness is extracted from the second opening of the storage casing, it is possible to assist extraction by opening the lid and manually pushing the cable harness through the casing opening. Therefore, it is possible to facilitate extraction of the cable harness and more improve workability. When the cable harness is put into the storage space from the second opening of the storage casing, it is possible assist the storage by opening the lid and manually pulling the cable harness through the casing opening. Therefore, it is possible to easily store the cable harness. If the cable harness is stored in the storage casing, the lid is installed in the casing body. As a result, it is possible to protect the cables.

In the printer described above, the casing body may have a bottom wall and a side wall provided along an outer periphery of the bottom wall to form the casing opening, the bottom wall may be arranged to face the feeding path side, the first opening may be formed on one side of the side wall in a width direction of the feeding path, and the second opening may be formed on the bottom wall. Since the second opening is provided on the bottom wall directed to the side of the feeding path where the print head is placed, it is possible to easily store and extract the cable harness.

The printer described above may further include: a locking protrusion provided on one side edge of the lid; a locking recess provided on the side wall of the casing body and detachably engageable with the locking protrusion of the lid; a holding piece provided on the other side edge of the lid to abut on the side wall of the casing body while the locking protrusion is engageable with the locking recess; and a fixing portion configured to releasably fix the holding piece to the side wall of the casing body.

As a result, when the lid is installed, the locking protrusion of the lid is engageable with the locking recess of the casing body by insertion, and the holding piece is fixed to the casing body using the fixing portion. When the lid is detached, the fixing portion is unfastened, and the locking protrusion of the lid is disengaged from the locking recess of the casing body. Therefore, it is possible to install or detach the lid in a very simple way and reliably fix the lid.

In the printer described above, the fixing portion may have a female thread formed to match the holding piece, and a bolt inserted into an installation hole formed on the holding piece to match the female thread and provided with a male thread portion screwed to the female thread and a bolt head connected to the male thread portion to manually rotate the male thread. Since the lid can be installed or detached through simple and easy manipulation by manually rotating the bolt, it is possible to improve workability.

In the printer described above, the head bracket may be provided pivotally around a pivot shaft on a machine housing and may be pivoted between a printing position in which the print head faces the platen roller and a separated position in which the print head is separated from the platen roller, and the cable harness can be extracted from the storage casing by detaching the print head from the head bracket in the separated position.

In this printer according to the present invention, it is possible to increase the length of the cable harness by the margin length longer than the length necessary to connect the cable harness to the print head. When maintenance or replacement for the print head is performed, it is possible to place the print head far from the head bracket or its peripherals by the margin length. As a result, it is possible to widen the work space and improve workability.

When the print head is installed in the head bracket, the cable harness can be stored in the storage casing. In this state, the cable harness is not exposed. Therefore, it is possible to prevent the margin length of the cable harness from being concentrated on one side of the feeding path and making contact with or being caught in peripherals to generate a failure.

DESCRIPTION OF EMBODIMENTS

A printer according to an embodiment of the invention will now be described with reference to the accompanying drawings.

Figure 1:
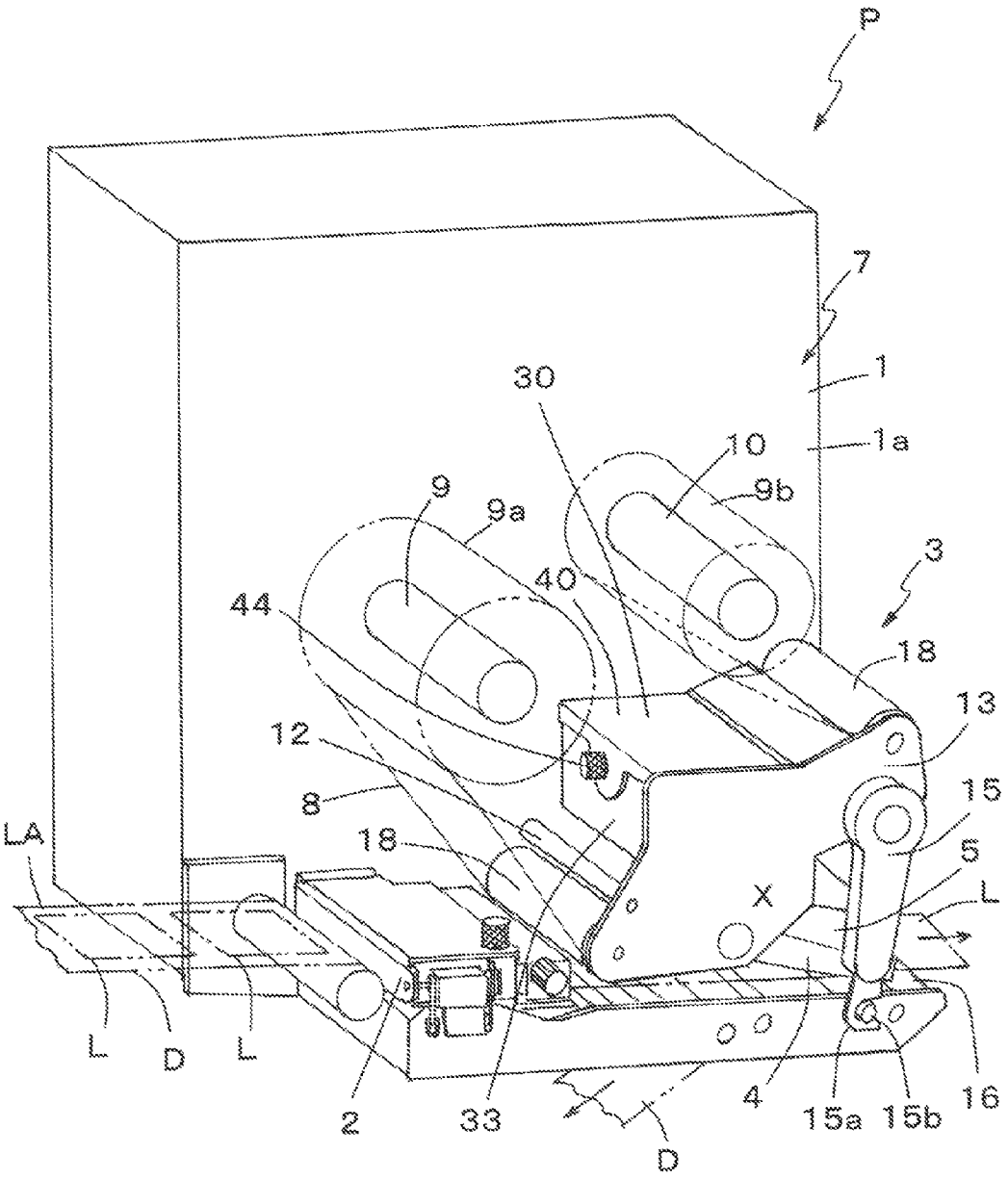
FIG. 1 is a perspective view illustrating a printer according to an embodiment of the invention.
Figure 5:
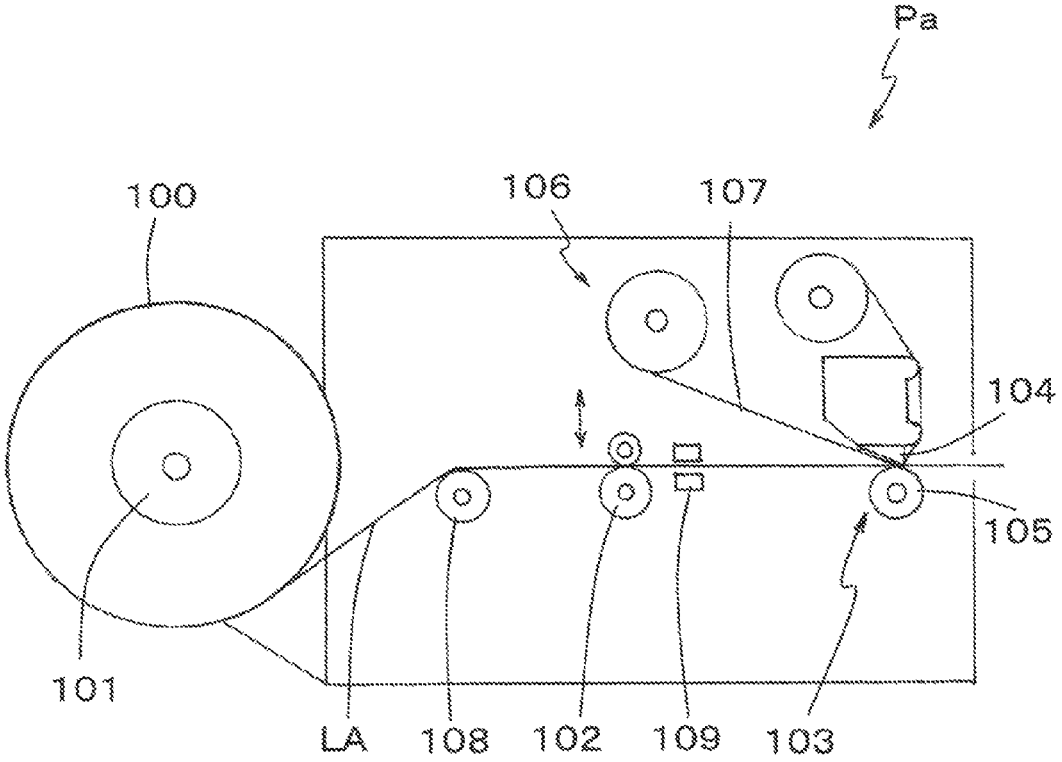
PRIOR ART FIG. 5
FIG. 5 is a diagram illustrating an exemplary printer in the prior art.
Figure 6:
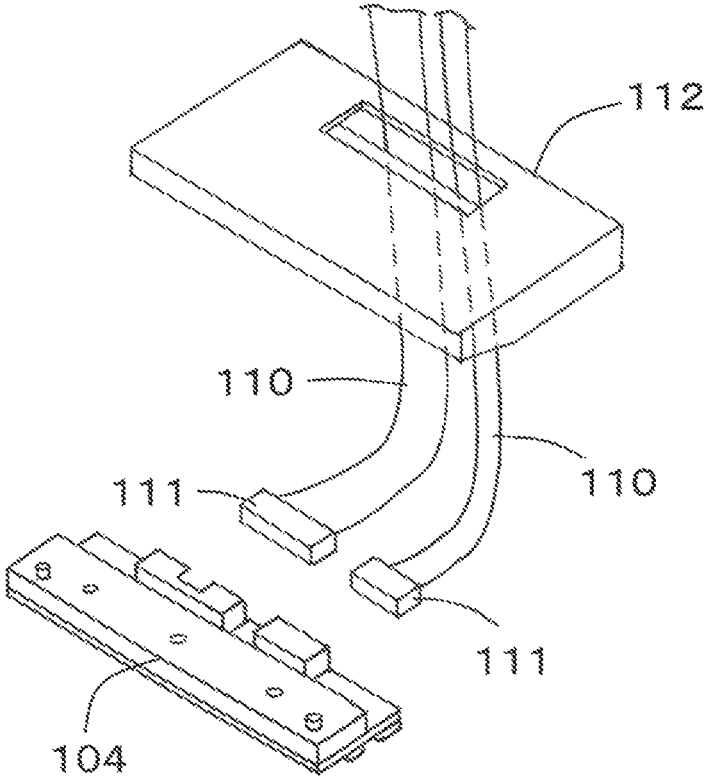
PRIOR ART FIG. 6
FIG. 6 is a perspective view illustrating a relationship between the print head of the printer and peripherals in the prior art.

Referring to FIG. 1, the printer P uses a continuous label sheet LA obtained by temporarily attaching glued labels L onto a band-shaped liner sheet D at equal intervals as a paper sheet. Similar to the prior art illustrated in FIG. 5, in the printer P, printing is performed on the labels L using the print unit 3 while the labels L are fed along a label link direction by extracting and feeding the continuous label sheet LA from a label roll (not shown) obtained by rolling up the continuous label sheet LA using a feed unit 2 having a feeding roller (not shown) installed in a machine housing 1.

As illustrated in FIGS. 1 to 4, the print unit 3 has a print head 4, a head bracket 5, and a platen roller 6. The print head 4 is a thermal type print head provided on one side of a feeding path where the continuous label sheet LA as a paper sheet is fed to perform printing on the labels L fed along the feeding path. The print head 4 performs printing on the labels L through heat transfer using an ink ribbon 8 fed from the ribbon feeding mechanism 7. The print head 4 is detachably installed in the head bracket 5. The platen roller 6 is provided on the other side of the feeding path to face the print head 4.

The ribbon feeding mechanism 7 is provided with roll shafts 9 and 10. A roll 9*a* of the ink ribbon 8 is installed in the roll shaft 9. A roll 10*a* where the consumed ink ribbon 8 is rolled up is installed in the roll shaft 10.

The head bracket 5 is installed in the machine housing 1 pivotally around a pivot shaft 11. The head bracket 5 can be pivoted between a printing position X (FIGS. 1 and 3) in which the print head 4 faces the platen roller 6 provided on the other side of the feeding path and a separated position Y (FIG. 2) in which the print head 4 is separated from the platen roller 6.

Figure 3:
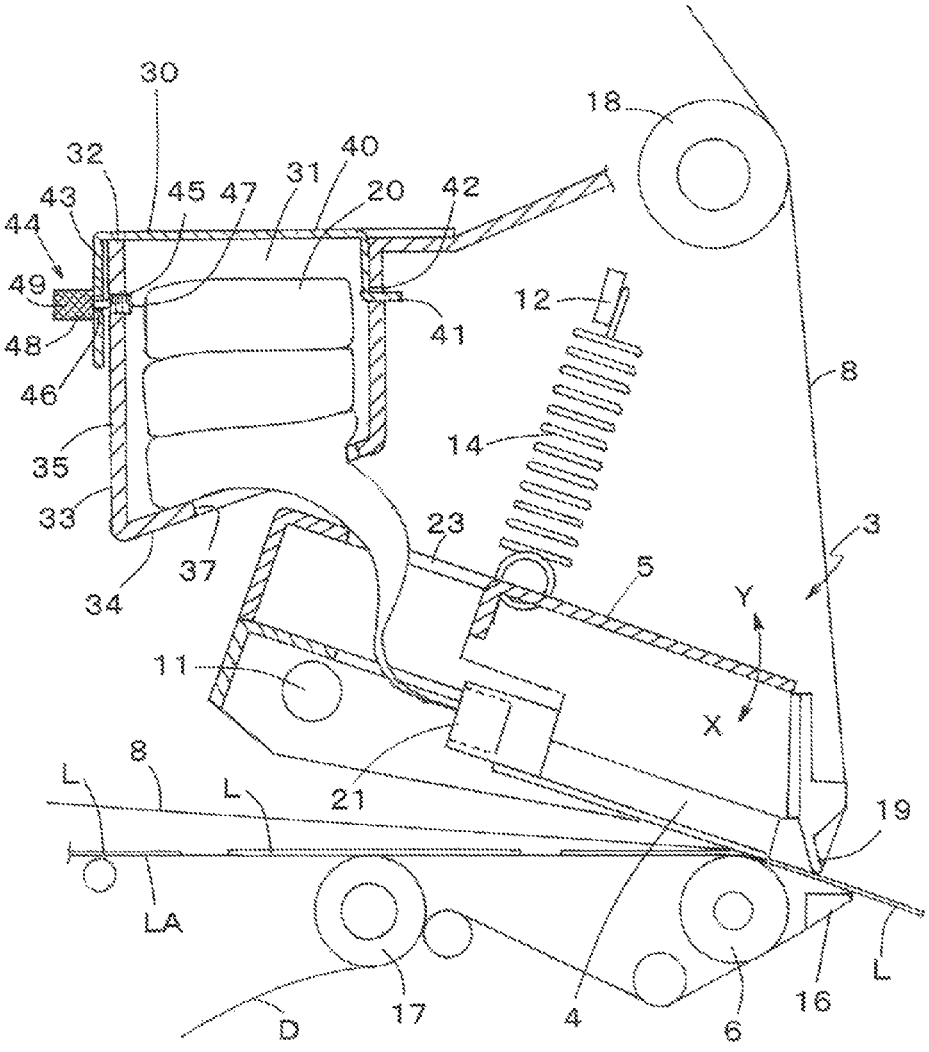
FIG. 3 is a cross-sectional side view illustrating main parts of the printer according to an embodiment of the invention.

The pivot shaft 11 of the head bracket 5 is bridged between the side plate 1*a* of the machine housing 1 and the fixing plate 13 fixed to the side plate 1*a* using a plurality of bridge members 12. As illustrated in FIG. 3, the head bracket 5 is biased toward the separated position Y by virtue of a coil spring 14 at all times. The coil spring 14 has one end moored to the head bracket 5 and the other end moored to the bridge member 12 connected between the side plate 1*a* of the machine housing 1 and the fixing plate 13.

Figure 2:
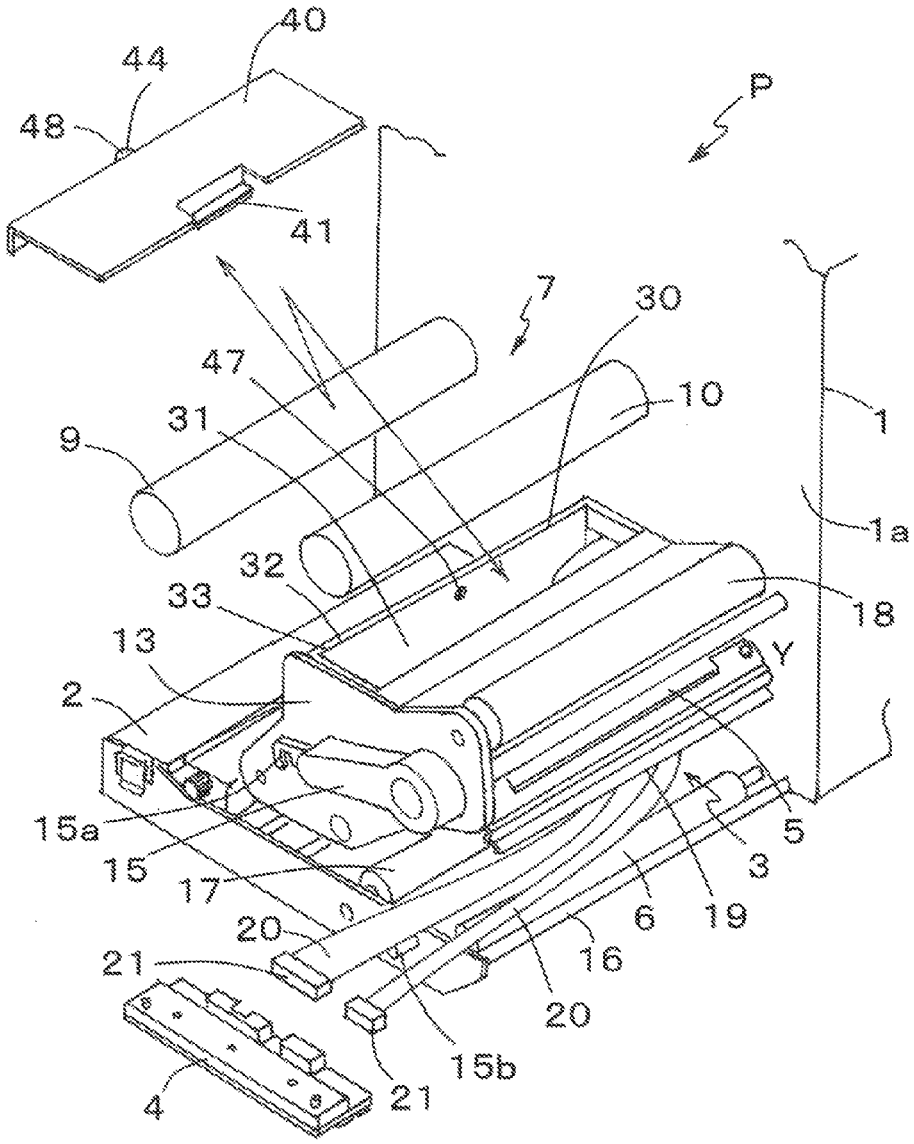
FIG. 2 is a perspective view illustrating a printer according to an embodiment of the invention while a print head is detached.

As illustrated in FIGS. 1 and 2, the fixing plate 13 is provided with a lever 15 pivoted to shift the head bracket 5 resisting to the biasing force of the coil spring 14 and place the print head 4 in the printing position X. If a latching recess 15*a* provided on the tip of the lever 15 is latched to a latching pin 15*b* of the machine housing 11, the head bracket 5 is locked to the printing position X of the print head 4.

As illustrated in FIGS. 1 to 3, a stripping plate 16 is provided in the downstream side of the platen roller 6 to allow the band-shaped liner sheet D to turn around and strip and feed the labels L from the band-shaped liner sheet D. The turned band-shaped liner sheet D is conveyed and discharged to a bottom side of the machine using a discharge roller 17. A guide roller 18 and a guide member 19 for the ink ribbon 8 are bridged between the side plate 1*a* and the fixing plate 13.

Figure 4:
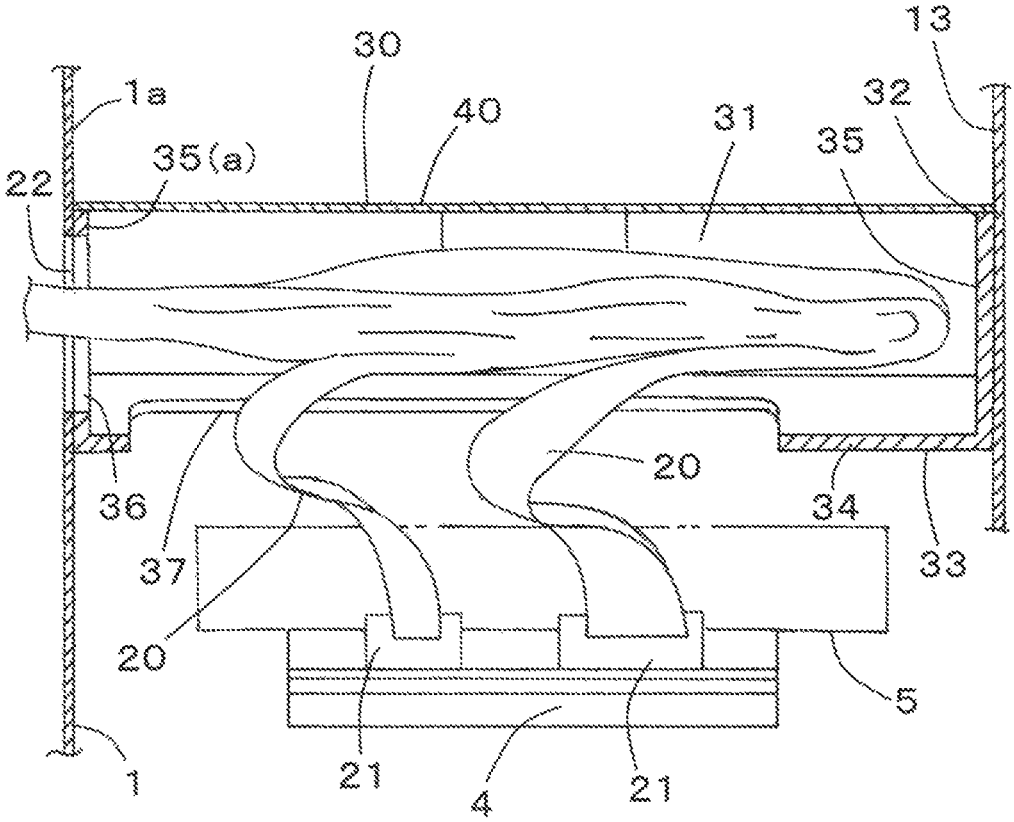
FIG. 4 is a cross-sectional front view illustrating main parts of the printer according to an embodiment of the invention.

As illustrated in FIGS. 2 to 4, a tip of a cable harness 20 stretching to one side of the feeding path is detachably connected to the print head 4 by interposing a connector 21. The cable harness 20 passes through a through-hole 22 formed on a predetermined position of the side plate 1*a* of the machine housing 1 and stretches to the downside of the head bracket 5 while it is collectively stored. The cable harness 20 has a margin length longer than the length necessary to connect to the print head 4, so that the print head 4 can be removed from the head bracket 5 and can be carried to the outside of the printer P. The margin length is set, for example, such that the print head 4 can be removed from the head bracket 5 and can be carried to the outside of the printer P to allow the print head 4 to be separated from the printer P by several centimeters.

In the printer P according to this embodiment, as illustrated in FIGS. 1 to 4, a storage casing 30 having a storage space 31 for storing the cable harness 20 is provided on one side of the feeding path. The storage casing 30 is placed over the head bracket 5 in the upstream side and is bridged between the side plate 1*a* of the machine housing 1 and the fixing plate 13. Specifically, the storage casing 30 has a casing body 33 having a container shape and being provided with a casing opening 32 on its top and an openable/closable lid 40 for the casing opening 32.

The casing body 33 has a bottom wall 34 and a side wall 35 provided along an outer periphery of the bottom wall 34 to form the casing opening 32. The bottom wall 34 is sloped to elevate from the upstream side to the downstream side. The casing body 33 is arranged such that the bottom wall 34 faces the feeding path.

One side 35(*a*) of the side wall 35 in the width direction of the feeding path is bonded to a position of the through-hole 22 of the side plate 1*a*. The one side 35(*a*) of the side wall 35 in the width direction of the feeding path is provided with a first opening 36 mated with the through-hole 22 to insert a base end side of the cable harness 20 and draw the cable harness 20 to the storage space 31.

The bottom wall 34 is provided with a second opening 37 to allow the cable harness 20 stretching to one side of the feeding path to access the storage space 31. The second opening 37 is formed by cutting out the area of the bottom wall 34 by 50 to 70%.

The lid 40 is formed in a plate shape capable of covering the casing opening 32 and is provided with a locking protrusion 41 in the center of the one side edge in the downstream side. A locking recess 42 detachably engageable with the locking protrusion 41 of the lid 40 is provided on the center of the side wall 35 in the downstream side of the casing body 33. A holding piece 43 abutting on the side wall 35 of the casing body 33 while the locking protrusion 41 is engageable with the locking recess 42 is provided on the center of the other side edge of the lid 40 in the upstream side through bending. A fixing portion 44 is provided to releasably fix the holding piece 43 to the side wall 35 of the casing body 33.

As illustrated in FIG. 3, the fixing portion 44 includes a female thread 45 formed to match the holding piece 43 of the side wall 35 of the casing body 33, an installation hole 46 provided on the holding piece 43 to match the female thread 45, and a bolt 49 provided with a male thread portion 47 inserted into the installation hole 46 and screwed to the female thread 45 and a bolt head 48 connected to the male thread portion 47 to manually rotate the male thread portion 47. The installation hole 46 has a diameter smaller than a maximum diameter of the male thread portion 47. A base end portion of the male thread portion 47 adjoining the bolt head 48 of the bolt has a diameter smaller than the maximum diameter of the male thread portion 47, and the base end portion of the male thread portion 47 is inserted into the installation hole 46. For this reason, the bolt 49 is held not to be easily detached from the installation hole 46 and not to be removed from the holding piece 43 of the lid 40 when it is unfastened. The bolt head 48 is knurled in order to facilitate a hand grip.

In the printer P according to an embodiment of the invention, as illustrated in FIGS. 3 and 4, the cable harness 20 stretching to one side of the feeding path is stored in the storage casing 30 while the print head 4 is installed in the head bracket 5. When printing is performed on the labels L, the print head 4 is placed in the printing position X by manipulating the lever 15, and the continuous label sheet LA is fed using the feed unit 2, so that the print head 4 of the print unit 3 performs printing.

In the event of maintenance or replacement for the print head 4, as illustrated in FIG. 2, the print head 4 is detached from the head bracket 5, and the print head 4 is carried to the outside after or while the cable harness 20 is extracted from the storage casing 30 through the second opening 37. In this state, maintenance or replacement of the print head 4 is performed. In the event of maintenance, the maintenance may be performed while the print head 4 is connected to the cable harness 20. Since the cable harness 20 is sufficiently long, it is possible to hold the print head 4 away from the head bracket 5 or its peripherals as distant as the margin length. Therefore, it is possible to widen a work space and improve workability.

Since the cable harness 20 is inserted into the first opening 36, passes through the second opening 37 of the storage casing 30, reaches the print head 4, it is possible to easily extract the cable harness 20 stretching to one side of the feeding path from the storage space 31 while it is collectively stored. Since the second opening 37 is provided on the bottom wall 34 directed to the side of the feeding path where the print head 4 is placed, it is possible to easily extract the cable harness 20.

The maintenance or replacement work may be performed by opening the lid 40. When the lid 40 is removed, the bolt 49 is unfastened by rotating the bolt head 48 of the bolt 49, and the locking protrusion 41 of the lid 40 is disengaged from the locking recess 42 of the casing body 33. Since the lid 40 can be detached through simple and easy manipulation by manually rotating the bolt 49, it is possible to improve workability. While the lid 40 is opened, it is possible to assist the extraction work of the cable harness 20 by manually pushing it through the casing opening 32. Since the extraction work of the cable harness 20 can be facilitated, it is possible to improve workability.

Next, in order to install the print head 4 in the head bracket 5 while the print head 4 is installed in the connector 21 of the cable harness 20, the cable harness 20 is put into the storage space 31 from the second opening 37 of the storage casing 30. In this case, the cable harness 20 is stored in the storage casing 30 during installation of the print head 4. Alternatively, the cable harness 20 is collectively stored in the storage casing 30 after the print head 4 is installed. This work may be performed while the lid 40 is opened. While the lid 40 is opened, it is possible to assist the storage by manually pulling the cable harness 20 through the casing opening 32. Therefore, it is possible to facilitate the storage of the cable harness 20.

The cable harness 20 is inserted into the first opening 36, passes through the second opening 37 of the storage casing 30, and reaches the print head 4. Therefore, it is possible to easily put the cable harness 20 into the storage space 31 for storage while it is collectively stored. While the cable harness 20 is stored in the storage casing 30, it is possible to trimly arrange the cable harness 20 without tangling. Since the second opening 37 is provided on the bottom wall 34 directed to the side of the feeding path where the print head 4 is placed, it is possible to facilitate the storage of the cable harness 20.

If the cable harness 20 is stored in the storage casing 30, the lid 40 is installed in the casing body 33 to protect the cables. For this purpose, the locking protrusion 41 of the lid 40 is engageable with the locking recess 42 of the casing body 33 by insertion, and the holding piece 43 is fixed to the casing body 33 by rotating the bolt head 48 of the bolt 49 by screwing. Since the lid 40 can be installed through simple and easy manipulation by manually rotating the bolt 49, it is possible to improve workability. In addition, the cables can be protected by the lid 40.

While the cable harness 20 is stored in the storage casing 30, the cable harness 20 is not exposed. Therefore, it is possible to prevent the margin length of the cable harness from being concentrated on one side of the feeding path and making contact with or being caught in peripherals to generate a failure.

Although embodiments of this invention have been described hereinbefore, the aforementioned embodiments are just a part of applications of this invention, and are not intended to limit the technical scope of this invention to specific configurations of the aforementioned embodiments.

For example, although the present invention is applied to a printer that performs printing using the print head 4 in combination with the ink ribbon 8 in the aforementioned embodiments, the invention is not limited thereto. The present invention may also be applicable to a printer that uses a heat sensitive sheet on the label L without the ink ribbon 8. Alternatively, although the continuous label sheet LA is employed as a paper sheet in the aforementioned embodiments, the paper sheet may include a linerless continuous label sheet or any other types of paper sheets.

This application is based on and claims priority to Japanese Patent Application Laid-open No. 2014-107674 (filed in Japan Patent Office on May 26, 2014), the entire content of which is incorporated herein by reference.

The invention claimed is:

1. A printer comprising:

a print head provided on one side of a feeding path used to feed a paper sheet to perform printing on the paper sheet fed along the feeding path;

a cable harness stretching to the one side of the feeding path and having a tip connected to the print head;

a head bracket in which the print head is detachably installed; and a platen roller provided on the other side of the feeding path to face the print head; wherein the cable harness has a margin length such that when the print head is removed from the head bracket, the print head can be carried to an outside of the printer.

2. The printer according to claim 1, further comprising a storage casing provided on the one side of the feeding path and provided with a storage space configured to store the cable harness.

3. The printer according to claim 2, wherein the storage casing has a casing body having a container shape and a casing opening for assisting an extraction/storage of the cable harness.

4. The printer according to claim 3, further comprising an openable/closable lid for the casing opening.

5. The printer according to claim 4, wherein the storage casing has a first opening used to insert a base end side of the cable harness and draw the cable harness to the storage space, and a second opening configured to allow the cable harness to stretch to the one side of the feeding path to access the storage space, and the first and second openings being formed on the casing body.

6. The printer according to claim 5, wherein the casing body has a bottom wall and a side wall provided along an outer periphery of the bottom wall to form the casing opening, the bottom wall being arranged to face the feeding path side, the first opening being formed on one side of the side wall in a width direction of the feeding path, and the second opening being formed on the bottom wall.

7. The printer according to claim 6, further comprising:

a locking protrusion provided on one side edge of the lid;

a locking recess provided on the side wall of the casing body and detachably engageable with the locking protrusion of the lid;

a holding piece provided on the other side edge of the lid to abut on the side wall of the casing body while the locking protrusion is engageable with the locking recess; and a fixing portion configured to releasably fix the holding piece to the side wall of the casing body.

8. The printer according to claim 7, wherein the fixing portion has a female thread formed to match the holding piece, and a bolt inserted into an installation hole formed on the holding piece to match the female thread and provided with a male thread portion screwed to the female thread and a bolt head connected to the male thread portion to manually rotate the male thread portion.

9. The printer according to claim 1, wherein the head bracket is provided pivotally around a pivot shaft on a machine housing and is pivotable between a printing position in which the print head faces the platen roller and a separated position in which the print head is separated from the platen roller, and the cable harness can be extracted from a storage casing by detaching the print head from the head bracket in the separated position.

* * * * *